US005656405A

United States Patent [19]

Tsushima

[11] Patent Number: 5,656,405

[45] Date of Patent: Aug. 12, 1997

[54] ORGANIC PHOTOCONDUCTOR FOR ELECTROPHOTOGRAPHY

[75] Inventor: Akane Tsushima, Tokyo, Japan

[73] Assignee: Fuji Electric Co., Ltd., Kawasaki, Japan

[21] Appl. No.: 583,495

[22] Filed: Jan. 5, 1996

[30] Foreign Application Priority Data

Jan. 12, 1995 [JP] Japan ..... 7-002998

[51] Int. Cl.[6] ..... G03G 5/14

[52] U.S. Cl. ..... 430/59; 430/58; 430/64; 430/65; 430/69

[58] Field of Search ..... 430/64, 65, 69, 430/59, 58

[56] References Cited

U.S. PATENT DOCUMENTS 5,229,239 7/1993 Yu .
5,512,399 4/1996 Kawata et al. ..... 430/69
5,556,728 9/1996 Nogami et al. ..... 430/64

FOREIGN PATENT DOCUMENTS 58-63945 4/1983 Japan .
59-154460 9/1984 Japan .

OTHER PUBLICATIONS

Borsenberger, Paul M. and David Weiss. Organic Photoreceptors for Imaging Systems. New York: Marcel–Dekker, Inc. pp. 289–292. 1993.

*Primary Examiner*—Christopher D. Rodee
*Attorney, Agent, or Firm*—Morrison Law Firm

[57] ABSTRACT

An organic photoconductor for electrophotography that is light in weight, yields excellent images and is easily disposed of, which comprises a cylindrical conductive substrate that contains cross-linked polyphenylene sulfide as its main component, a blocking layer that contains melamine resin as its main component formed on the conductive substrate, a charge generation layer formed on the blocking layer, and a charge transport layer formed on the charge generation layer.

14 Claims, 1 Drawing Sheet

ORGANIC PHOTOCONDUCTOR FOR ELECTROPHOTOGRAPHY

BACKGROUND OF THE INVENTION

The present invention relates to organic photoconductors for electrophotography. More specifically, the present invention relates to organic photoconductors which use a cylindrical conductive substrate made of plastic material.

Recently, the so-called function-separation type organic photoconductors have been developed for electrophotography and put into market. As disclosed in the Japanese Examined Patent Publications No. S55-42380 and No. S60 34099, the function-separate type organic photoconductors have a charge generation layer on a conductive substrate, and a charge transport layer on the charge generation layer.

The charge generation layer and the charge transport layer contain organic materials as their main component. Usually, an aluminum alloy cylinder is used for the conductive substrate.

The charge generation layer is formed on the conductive substrate by coating and drying a coating liquid. The coating liquid consists of an organic solvent in which an organic charge generation agent together with a resin binder are dispersed and dissolved.

The charge transport layer is formed on the charge generation layer by coating and drying a coating liquid which consists of an organic solvent in which an organic charge transport agent together with a resin binder are dispersed and dissolved. If necessary, an antioxidant may be added to the charge transport layer.

However, image defects often occur in the above described conventional photoconductors. In more detail, image defects such as voids and grease streaks (greasing) are often caused in the normal development type electrophotographic apparatuses. Development type electrophotographic apparatuses are exemplified by plain paper copiers. Further, printing detects such as black spot and lowered contrast that frequently occur after repeated printing are often caused in the reversal development type electrophotographic apparatus. Reversal development type electrophotographic apparatus are exemplified by laser printers.

In addition, aluminum alloys used for photoconductor substrates can cause other problems. Recently, the detergent for cleaning the substrate has been switched from conventional freon detergents to aqueous detergents due to the environmental considerations such as causing the diminution of ozone in the atmosphere. However, image defects are caused by deposit residues remaining on aluminum alloys cleaned with aqueous detergents.

When the aluminum alloy substrate is coated with the charge generation layer and the charge transport layer, uneven coating is often caused by the high thermal conductivity of the aluminum alloy.

It is often necessary to roughen the substrate surface, form a light absorption layer, or form an irregular-reflection layer on the substrate to prevent interference fringes from forming on the images obtained in the electrophotographic apparatuses such as laser printers that use a white exposure light.

Although it has been a necessary objective to reduce the weight of the electrophotographic apparatuses, it is nevertheless difficult to reduce the weight of the photoconductors, since the specific gravity of the aluminum alloy is large.

Further, since the used photoconductors must be collected by specialized dealers, users cannot dispose of the used photoconductors easily.

OBJECTS AND SUMMARY OF THE INVENTION

In view of the foregoing, it is an object of the present invention to provide an organic photoconductor for electrophotography that is light in weight, facilitates obtaining excellent images, and is easily disposed of.

According to the present invention, there is provided an organic photoconductor for electrophotography that comprises a cylindrical conductive substrate made of plastic material containing cross-linked polyphenylene sulfide as its main component, a blocking layer on the conductive substrate, wherein the blocking layer contains melamine resin as its main component, a charge generation layer formed on the blocking layer, in which the charge generation layer contains organic material as its main component, and a charge transport layer formed on the charge generation layer, in which the charge transport layer contains organic material as its main component.

Briefly stated, an organic photoconductor for electrophotography that is light in weight, yields excellent images and is easily disposed of, comprises a cylindrical conductive substrate that contains cross-linked polyphenylene sulfide as its main component, a blocking layer that contains melamine resin as its main component formed on the conductive substrate, a charge generation layer formed on the blocking layer, and a charge transport layer formed on the charge generation layer.

According to an embodiment of the present invention, an organic photoconductor for electrophotography comprises a cylindrical conductive substrate made of a plastic material, the plastic material containing at least 50% by weight cross-linked polyphenylene sulfide, a blocking layer on the conductive substrate, a charge generation layer on the blocking layer, and a charge transport layer on the charge generation layer.

According to another embodiment of the present invention, an organic photoconductor for electrophotography comprises a cylindrical conductive substrate made of a plastic material, the plastic material containing at least 50% by weight cross-linked polyphenylene sulfide, a blocking layer on the conductive substrate, the blocking layer containing at least 50% by weight melamine resin, a charge generation layer on the blocking layer, the charge generation layer containing at least 50% by weight organic material, and a charge transport layer on the charge generation layer, wherein the charge transport layer containing at least 50% by weight organic material.

According to another embodiment of the present invention, an organic photoconductor for electrophotography comprises a cylindrical conductive substrate made of a plastic material, the plastic material containing a cross-linked polyphenylene sulfide as a main component, a blocking layer formed on the conductive substrate, the blocking layer containing melamine resin as a main component, a charge generation layer formed on the blocking layer, the charge generation layer containing organic material as a main component, and a charge transport layer formed on the charge generation layer, wherein the charge transport layer containing organic material as a main component.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
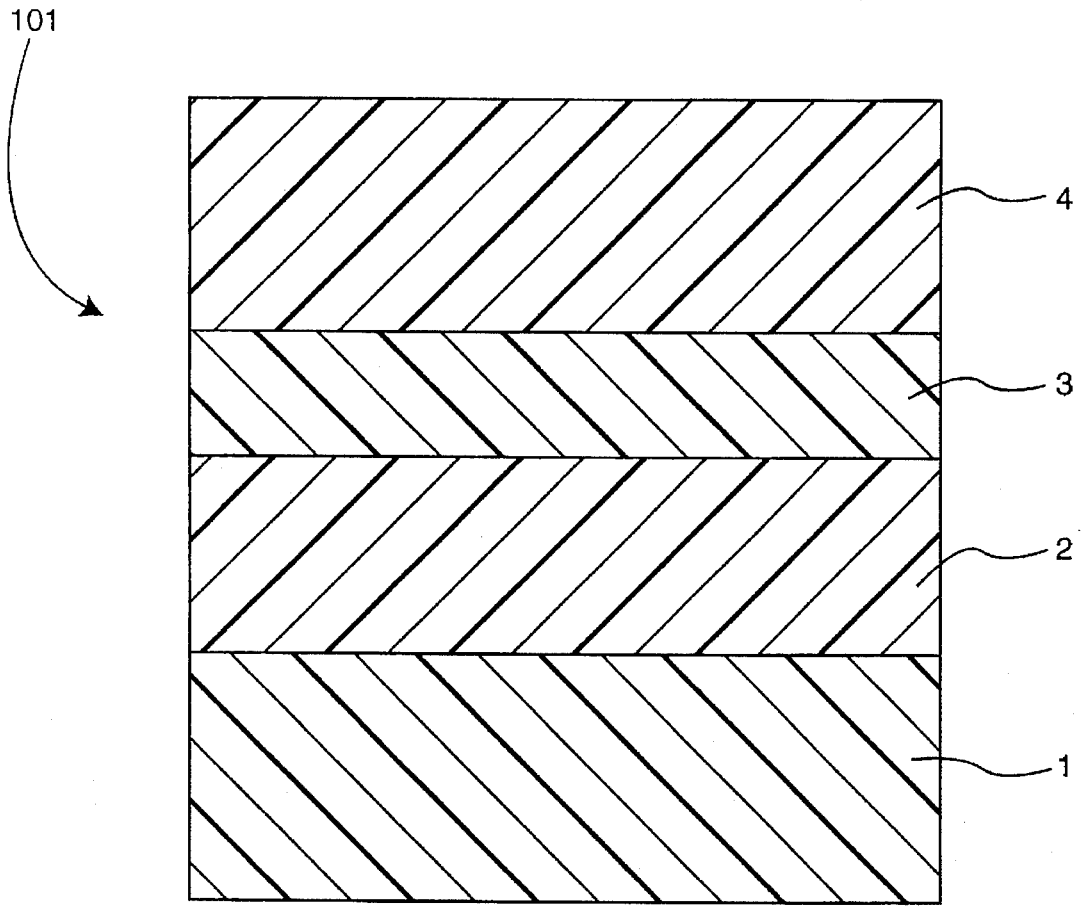
FIG. 1 is a cross sectional view of a schematic structure of the organic photoconductor for electrophotography according to the present invention.

In an embodiment of the present invention, it is advantageous to adopt a melamine resin, that is a thermosetting resin, for the material of the blocking layer. It is preferable to set the blocking layer as a film of melamine resin containing aromatic carboxylic acid and iodine added thereto, and/or aromatic carboxylic anhydride and iodine added thereto. Filler may be added to the blocking layer to prevent the formation of interference fringes. In addition, it is preferable that the blocking layer be about three times as thick as the surface roughness $R_{MAX}$ of the substrate.

The charge generation layer is formed as a coating film of an organic charge generation agent and a resin binder. An appropriate agent is selected that matches the wavelength of the exposure light used in the image formation process.

The charge transport layer is formed as a coating film that comprises at least one organic charge transport agent such as poly(vinylcarbazole), oxadiazole, imidazole, pyrazoline, hydrazone, stilbene, etc., and resin binder. If necessary, an antioxidant, such as an ultraviolet ray absorbing agent, may be added.

The substrate is a cross-linked polyphenylene sulfide. The specific gravity of the resulting substrate is reduced compared to aluminum. Consequently, because the cross-linked polyphenylene sulfide is the main component of the substrate, the weight of the substrate is reduced. This substrate, easily formed by injection molding, results with excellent dimensional precision against deformation from chemical and thermal activity.

The substrate maintains its surface profile stably without deterioration, even when the substrate is cleaned with an aqueous detergent. Thus, image defects such as black spots, voids, etc. are greatly reduced. Further, the thermal conductivity of the substrate is low. Thus, organic films may be formed uniformly on the substrate by coating.

A further provision of the blocking layer that contains melamine resin as its main component requires that the surface of the substrate be smooth. Thus, the formation of organic coating films uniformly is facilitated by the smooth surface of the substrate. Furthermore, since the charge injection from the substrate to the charge generation layer is thus optimized. Therefore, image defects such as voids, greasing, black spots, and lowered image contrast from repeated use are substantially prevented from occurring.

Referring to FIG. 1, an organic photoconductor, generally shown as 101, includes a blocking layer 2 formed on a cylindrical conductive substrate 1. Substrate 1 contains cross-linked polyphenylene sulfide as its main component. The blocking layer 2 contains melamine resin as its main component. A charge generation layer 3 is formed on the blocking layer 2. A charge transport layer 4 is formed on the charge generation layer 3.

First Embodiment

A cylindrical conductive substrate 1 (the surface roughness $R_{MAX}$ thereof is about 3 μm), that contains cross-linked polyphenylene sulfide as its main component, was used in the photoconductor of the first embodiment. A blocking layer 2 was formed on cylindrical conductive substrate 1 by immersion coating of a coating liquid consisting of 20 weight parts of ethanol in which 50 weight parts of a melamine resin (Uban 2020 supplied from Mitsui Toatsu Chemicals Inc.) was dissolved, and to which 6 wt. % of iodine was added. Blocking layer 2 was formed to a thickness of 10 μm by drying the coating liquid at 130° C. for 20 min. Charge generation layer 3 was formed on blocking layer 2 to a thickness of about 0.3 μm by immersion coating of a coating liquid consisting of 100 weight parts of tetrahydrofuran in which 1 weight part of X-type metal-free phthalocyanine (FASTGEN BLUE 8120 supplied from DAINIPPON INK & CHEMICALS INC.) and 1 weight part of poly(vinyl butyral) were dispersed and dissolved. This layer was dried.

Charge transport layer 4 was formed on charge generation layer 3 to a thickness of about 20 μm by immersion coating of a coating liquid consisting of 80 weight parts of tetrahydrofuran in which 10 weight parts of a hydrazone compound (CTC 191 supplied from Anan Corporation), and 10 weight parts of polycarbonate resin (L-1225 supplied from TEIJIN LTD.) were dissolved. This layer was dried.

The photoconductor of the first embodiment exhibits excellent sensitivity (half decay exposure light intensity) of 0.4 J/cm$^2$ for a beam (wavelength 780 nm) from a semiconductor laser diode. A printing test was conducted on the photoconductor in a commercially supplied laser beam printer. The results of the test showed that no image defects such as black spots were observed. Images with high printing contrast and high resolution were obtained. Finally, no change of the printing contrast were caused by continuous printing.

Second Embodiment

A cylindrical conductive substrate that contains cross-linked polyphenylene sulfide as its main component was used in the photoconductor of the second embodiment. Blocking layer 2 was formed on cylindrical conductive substrate 1 by immersion coating of a coating liquid consisting of 20 weight parts of ethanol in which 50 weight parts of a melamine resin (Uban 20RI supplied from Mitsui Toatsu Chemicals Inc.) was dissolved, and 6 wt. % of iodine and 1 weight part of silicon oxide (Hydrophobic Silica Gel R-212 supplied from Nippon Aerozil Co., Ltd.) were added. This layer was dried.

Blocking layer 2 was formed to a thickness of 10 μm by drying the coating liquid at 130° C. for 20 min. Charge generation layer 3 and charge transport layer 4 were formed successively on blocking layer 2 in the same way as in the first embodiment.

The photoconductor of the second embodiment exhibits excellent sensitivity (half decay exposure light intensity) of 0.4 J/cm$^2$ for a beam (wavelength 780 nm) from a semiconductor laser diode. A printing test was conducted on the photoconductor in a commercially supplied laser beam printer. The results of the test showed no image defects such as black spots observed. High printing contrast and images of high resolution were obtained. Further, no change of the printing contrast was caused by continuous printing.

Third Embodiment

Cylindrical conductive substrate 1 that contains cross-linked polyphenylene sulfide as its main component was used in the photoconductor of the third embodiment. Blocking layer 2 was formed on cylindrical conductive substrate 1 by immersion coating of a coating liquid consisting of 20 weight parts of ethanol in which 50 weight parts of a melamine resin (Uban 20RI supplied from Mitsui Toatsu Chemicals Inc.) was dissolved, and 6 wt. % of iodine was added. Blocking layer 2 was formed to a thickness of 10 μm by drying the coating liquid at 130° C. for 20 min.

Charge generation layer 3 was formed on blocking layer 2 to a thickness of about 0.3 μm by immersion coating of a coating liquid consisting of 100 weight parts of tetrahydrofuran in which 1 weight part of an azo pigment having a structure shown in the following formula (1) and 1 weight part of a poly(vinyl butyral) resin (BH-S supplied from Sekisui Chemical Co., Ltd.) were dispersed and dissolved. Charge transport layer 4 was formed on charge generation layer 3 to a thickness of about 20 μm by immersion coating of a coating liquid consisting of 80 weight parts of tetrahydrofuran in which 10 weight parts of a compound having a structure shown in the following formula (2) was dissolved.

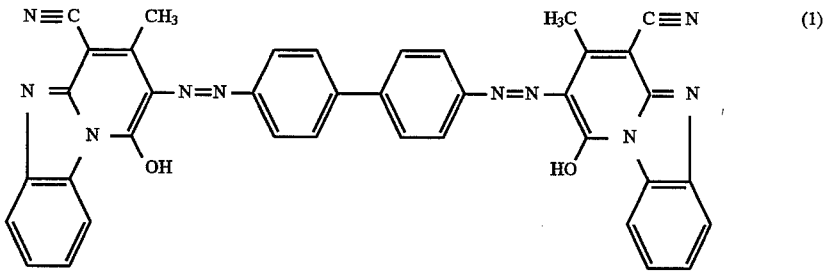

(1)

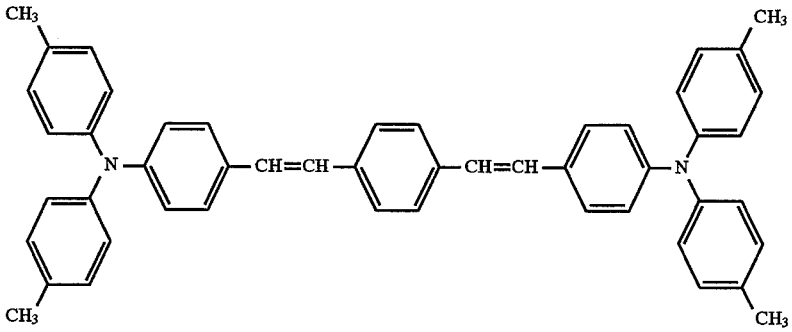

(2)

The photoconductor of the third embodiment exhibits excellent sensitivity (half decay exposure light intensity) of 0.81 lux-sec for a beam from a halogen lamp. A printing test was conducted on the photoconductor in a commercially supplied copying machine. As the test determined, no image defects such as voids, etc. were observed. High printing contrast and excellent graduation sequence were obtained.

Fourth Embodiment

Cylindrical conductive substrate 1 that contains cross-linked polyphenylene sulfide as its main component was used in the photoconductor of the fourth embodiment. Blocking layer 2 was formed on cylindrical conductive substrate 1 by immersion coating of a coating liquid consisting of 20 weight parts of ethanol in which 50 weight parts of a melamine resin (Uban 2020 supplied from Mitsui Toatsu Chemicals Inc.) was dissolved, and 6 wt. % of iodine and 1 weight part of silicon oxide (Hydrophobic Silica Gel R-212 supplied from Nippon Aerozil Co., Ltd.) were added. Charge generation layer 3 and charge transport layer 4 were formed successively on the blocking layer in the same way as in the third embodiment. This layer was dried.

The photoconductor of the fourth embodiment exhibits excellent sensitivity (half decay exposure light intensity) of 0.81 lux-sec for a beam from a halogen lamp. A printing test was conducted on the photoconductor in a commercially supplied copying machine. The test showed that no image defects such as voids, etc., were observed. High printing contrast and excellent graduation sequence were obtained.

The organic photoconductor for electrophotography of the present invention exhibits the following effects. By using cross-linked polyphenylene sulfide, the specific gravity thereof is small. Consequently, because the polyphenylene sulfide is the main component of the substrate, the weight of the substrate is reduced.

The substrate of the invention is easily formed by injection molding with excellent dimensional precision but with minimal chemical and thermal deformation. Since the substrate maintains its surface profile stably without deterioration even when the substrate is cleaned with an aqueous detergent, the image defects such as black spots, voids, etc. are greatly diminished. Furthermore, since the thermal conductivity of the substrate is advantageously low, the blocking layer, the charge generation layer, and the charge transport layer can be formed uniformly by coating on the substrate.

By the further restriction provision of the blocking layer that requires a melamine resin as its main component, image defects such as void, greasing, black spots, and image contrast lowering by repeated use are prevented from occurring.

Thus, the present invention facilitates providing organic photoconductors for electrophotography which are light in weight and facilitate obtaining excellent images stably.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An organic photoconductor for electrophotography comprising:

a cylindrical conductive substrate made of a plastic material;

said cylindrical conductive substrate containing at least 50% by weight of a cross-linked polyphenylene sulfide;

a blocking layer formed on said conductive substrate, said blocking layer containing at least 50% by weight melamine resin;

a charge generation layer formed on said blocking layer; and a charge transport layer formed on said charge generation layer.

2. An organic photoconductor for electrophotography according to claim 1 wherein said blocking layer containing about 87.7% by weight melamine resin, about 10.5% by weight iodine, and about 1.7% by weight silicon oxide.

3. An organic photoconductor for electrophotography according to claim 2 wherein said blocking layer is about 10 μm thick.

4. An organic photoconductor for electrophotography according to claim 1 wherein said blocking layer containing about 89.3% by weight melamine resin, and about 10.7% by weight iodine.

5. An organic photoconductor for electrophotography according to claim 4 wherein said blocking layer is about 10 μm thick.

6. An organic photoconductor for electrophotography according to claim 1 wherein said charge generation layer containing at least 50% by weight organic material.

7. An organic photoconductor for electrophotography according to claim 1 wherein said charge generation layer containing about 50% by weight metal free phthalocyanine and about 50% by weight poly(vinyl butyral).

8. An organic photoconductor for electrophotography according to claim 7 wherein said charge generation layer is about 0.3 μm thick.

9. An organic photoconductor for electrophotography according to claim 1 wherein said charge generation layer containing about 50% by weight azo pigment having the formula:

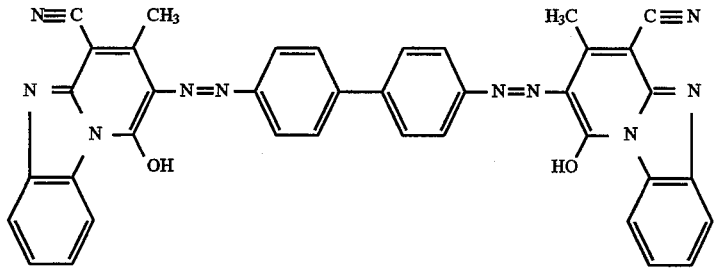

and about 50% by weight poly(vinyl butyral).

10. An organic photoconductor for electrophotography according to claim 1 wherein said charge transport layer containing at least 50% by weight organic material.

11. An organic photoconductor for electrophotography according to claim 1 wherein said charge transport layer is a compound having a structure shown in the formula:

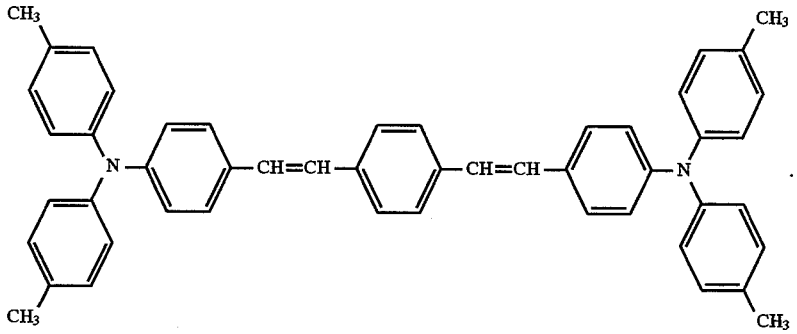

12. An organic photoconductor for electrophotography according to claim 1 wherein said charge transport layer containing about 50% by weight hydrazone and about 50% by weight polycarbonate.

13. An organic photoconductor for electrophotography according to claim 12 wherein said charge transport layer is formed to a thickness up to about 20 μm.

14. An organic photoconductor for electrophotography comprising:

a cylindrical conductive substrate made of a plastic material;

said cylindrical conductive substrate containing a cross-linked polyphenylene sulfide as a main component;

a blocking layer formed on said conductive substrate;

said blocking layer containing melamine resin as a main component;

a charge generation layer formed on said blocking layer;

said charge generation layer containing organic material as a main component; and a charge transport layer formed on said charge generation layer, wherein said charge transport layer containing organic material as a main component.

* * * * *